US006988968B2

(12) United States Patent
Okamoto

(10) Patent No.: US 6,988,968 B2
(45) Date of Patent: Jan. 24, 2006

(54) GRIP END BOTTOM WEIGHT AND GRIP END BOTTOM WEIGHTING STRUCTURE

(76) Inventor: Koji Okamoto, 9-3-910, Ujinamiyuki 1-chome, Minami-ku, Hiroshima-shi, Hiroshima (JP) 734-0015

( * ) Notice: Subject to any disclaimer, the term of this patent is extended or adjusted under 35 U.S.C. 154(b) by 0 days.

(21) Appl. No.: 10/450,811

(22) PCT Filed: Dec. 27, 2000

(86) PCT No.: PCT/JP00/09367

§ 371 (c)(1),
(2), (4) Date: Jun. 18, 2003

(87) PCT Pub. No.: WO02/053236

PCT Pub. Date: Jul. 11, 2002

(65) Prior Publication Data

US 2004/0038762 A1 Feb. 26, 2004

(51) Int. Cl.
*A63B 49/08* (2006.01)

(52) U.S. Cl. ..... 473/523; 473/520; 473/549

(58) Field of Classification Search ..... 473/519, 473/520, 521, 523, 524, 549, 551, 559, 560, 473/564, 568, 297

See application file for complete search history.

(56) References Cited

U.S. PATENT DOCUMENTS

| | | | | |
|---|---|---|---|---|
| 3,075,768 | A * | 1/1963 | Karns | 473/297 |
| 3,941,380 | A * | 3/1976 | Lacoste | 473/520 |
| 4,674,746 | A * | 6/1987 | Benoit | 473/297 |
| 4,811,947 | A * | 3/1989 | Takatsuka et al. | 473/523 |
| 4,936,586 | A * | 6/1990 | Van Raemdonck | 473/519 |
| 5,362,046 | A * | 11/1994 | Sims | 473/300 |
| 5,605,327 | A * | 2/1997 | McCutchen | 473/523 |
| 5,655,980 | A * | 8/1997 | Nashif et al. | 473/520 |
| 5,964,672 | A * | 10/1999 | Bianchi | 473/521 |
| 6,007,439 | A * | 12/1999 | MacKay, Jr. | 473/520 |
| 6,106,417 | A * | 8/2000 | Umlauft et al. | 473/537 |
| 6,117,028 | A * | 9/2000 | You | 473/520 |
| 6,625,848 | B1 * | 9/2003 | Schneider | 16/436 |
| 2002/0055403 | A1 * | 5/2002 | McCutchen | 473/524 |
| 2004/0038762 | A1 * | 2/2004 | Okamoto | 473/519 |

FOREIGN PATENT DOCUMENTS

EP 0 299 567 A2 * 1/1989

* cited by examiner

*Primary Examiner*—Raleigh W. Chiu
(74) *Attorney, Agent, or Firm*—Koda & Androlia

(57) ABSTRACT

A weight that is composed of a composite of a soft material and a loading member which is a high specific gravity substance and that is mounted on a grip end bottom of a ball-hitting implement, allowing the loading member to be divided into an internal weighting element and an external weighting element; and a grip end bottom weighting structure that uses this weight, in which the center of gravity is shifted closer to the portion grasped by hand, and the node of vibration on the grip is shifted to the grip fulcrum. When mounted, the loading member is disposed on either side of the grip end member, with soft material region interposed therebetween. The weight is at least flexible enough to be easily mounted and to be adjusted in balance, and it will not come off during play. This makes the ball-hitting implement head-light (grip-heavy) just prior to impact, which improves the player's swing or stroke, and also increases the moment of inertia around the center of gravity at the instant of impact and further suppresses or absorbs (attenuates) the vibration caused by impact.

14 Claims, 5 Drawing Sheets

GRIP END BOTTOM WEIGHT AND GRIP END BOTTOM WEIGHTING STRUCTURE

TECHNICAL FIELD

This invention relates to a grip end bottom weight and a grip end bottom weighting structure for a ball-hitting implement. The terms "weight" and "weighting body," "weighting weight" and "balance adjusting weighting body," and "center of impact (non-impact position)" and "node of vibration" are each used interchangeably.

BACKGROUND ART

In the field of ball-hitting implements, and particularly tennis rackets, it has long been the practice to lighten the racket body to make the racket easier to swing, and to adjust the balance (distribute the weight) to shift the center of gravity of the racket.

There have also been proposals aimed at reducing discomfort such as numbness or excessive load on the body by suppressing or absorbing (attenuating) the impact vibration at the instant the ball is hit.

For instance, Japanese Patent 2,853,926 and Japanese Patent Application Laid-Open No. H4-263876 disclose the provision of this sort of means to a grip end.

In these prior art, it is proposed that a loading member (weighting body) be mounted as a vibrator via an impact vibration-absorbing member. The effect of this proposal is said to be that it eliminates the increase in impact that occurs when a conventional weight is directly mounted to a grip end.

With the above prior art, however, the impact vibration-absorbing member and the loading member are either housed within the grip or attached on the outside; and there is no mention of the importance of balancing (weight distribution), especially as regards the weight pertaining to the weighting structure of the present invention (an increase in the moment of inertia around the center of gravity), nor is there any mention that the feel of hitting the ball is improved when the non-impact position (node of vibration) of the two-node flexural vibration on the grip produced when the racket hits the ball is shifted to the portion grasped by the hands (grip fulcrum).

Meanwhile, an overview of the main balancing means (including stabilizers) used to absorb impact vibration reveals that some are provided to the racket head (frame) or the middle part (throat), rather than to the grip end, but there is no mention whatsoever of the structure of the present invention, so a proposal such as this is outside the body of prior art.

In light of this, the inventor has already proposed a "Balancing Weighting Body for Ball-Hitting Implement" (Japanese Patent Application No. 2000-65171). In this application, the balancing means required to solve the above problem, and more specifically, a balancing weight protruding from the grip end bottom of a ball-hitting implement, is provided. The center of gravity position is shifted toward the portion grasped by the hands, and the moment of inertia around the center of gravity is increased, which raises head speed by facilitating snap movement centered around the wrist, and also absorbs impact vibration, thereby improving the characteristics of the ball-hitting implement.

The characteristic feature proposed here is to provide a balancing weight protruding from the bottom of the grip end cap or end rubber of the ball-hitting implement; and while the general object and effect were the same as in the present invention, there is room for improvement in the weight and the attendant weighting structure, including the distribution of weight for moving the center of impact (node of vibration) on the grip.

The general trend in tennis rackets in recent years has been to make them lightweight and top-heavy, This means that the node of vibration on the grip is farther away from the grip end when the ball is hit. While this does improve rebound, it also increases impact (vibration). The node of vibration is usually 90 to 180 mm (3.6 to 7.2 inches) away from the grip end, although this varies with differences in weight distribution.

The present invention is conceived in light of this situation; and it provides a grip end bottom weight and a grip end bottom weighting structure which raise the level of play, and afford simple mounting on the grip end bottom, which makes a racket easier to handle, which in turn increases head speed, and improves the damping effect (especially moving the node of vibration on the grip) in order to prevent injury and make it more comfortable to hit the ball.

As to applications of the present invention, a tennis racket is typical; however, the present invention is not limited to this and can be applied to soft tennis rackets, squash rackets, badminton rackets, or other such rackets, or to baseball or softball bats, golf clubs, ground golf clubs, gate ball clubs, hockey sticks, and other such ball-hitting implements.

DISCLOSURE OF INVENTION

In the present invention, a weight is provided so as to protrude from the grip end bottom of a tennis racket or other ball-hitting implement, which increases the moment of inertia around the center of gravity when a ball is hit, and also suppresses, absorbs, or attenuates impact vibration. At the same time, hitting the ball becomes more comfortable because the center of impact (node of vibration) on the grip is shifted to the portion grasped by the hands (grip fulcrum).

More specifically, the above structure provides head-light (grip-heavy) with the ball-hitting implement just prior to impact, which makes the implement easier to handle, and the moment of inertia around the center of gravity is increased at the instant of impact, so the player's swing or stroke is not overcome by the ball.

Furthermore, weighting balance can be adjusted by varying the weight distribution of the loading member or the mounting position of the weight.

The first invention is a grip end bottom weight (hereinafter referred to as "weight"), characterized in that a soft material, capable of absorbing impact vibrations and compositely integrated with a loading member composed of a high specific gravity substance, has axially symmetric wall thickness in cross section and can be mounted by elastically deforming a body component into a mounting hole formed in the grip end bottom, and at least the half of the body component protrudes from the grip end bottom after mounting. The weight here is designed such that the center of impact (node of vibration) on the grip is shifted to the portion grasped by the hands (grip fulcrum).

The second invention is a grip end bottom weighting structure (hereinafter referred to as "weighting structure"), characterized in that the above-described weight is removably mounted on the grip end of a ball-hitting implement, the moment of inertia around the center of gravity is increased at the moment a ball is hit, and impact vibration is suppressed, absorbed, or attenuated.

Here, the grip end bottom weighting structure includes a grip end member including an end cap or end rubber and having a mounting hole formed in the planar center, a loading member composed of a high specific gravity substance, and a soft material compositely integrated with the loading member, and the soft material has axially symmetric wall thickness in cross section and can be mounted by elastic deformation of a body component, at least the half of the body component is fixed to protrude from the grip end bottom of the ball-hitting implement, and a soft material region is interposed in the grip end member so as to isolate the loading member.

In the present invention constituted as described above, the composite integration results in the loading member being incorporated into, embedded in, surrounded by, joined to, compounded with, or dispersedly compounded with in a matrix of the soft material. As will be discussed below, the typical shape of the soft material is an approximate barrel shape, and a circumferential groove or flange is provided around the large-diameter middle of the soft material. A body component is elastically deformed and non-rotatably restrained (fitted) in a mounting hole, and the soft material is balance-mounted, with one half of the body housed inside the grip via the side walls of the mounting hole, and the other half of the body protruding from the grip end bottom. This prevents the weight from coming loose during play.

Also, the mounting hole is formed by boring out the bottom surface of a grip end member including an end cap or end rubber.

Also, the soft material is mounted by being removably fitted, pressed, squeezed, or threaded into the mounting hole by stored elastic energy.

Further, the loading member is disposed at the two ends of the soft material, with its weight divided into an internal weighting element and an external weighting element when mounted.

In view of the above, mounting the weight structured as above on a ball-hitting implement increases the moment of inertia around the center of gravity when the ball is hit and thus increases rebound and absorbs (attenuates) impact vibration. At the same time, the weight is distributed so that the center of impact (node of vibration) on the grip is shifted to the portion grasped by the hands (grip fulcrum), so hitting the ball is more comfortable.

As a result, the implement is head-light (grip-heavy) when not hitting a ball (until just prior to impact); and it is easier to snap the implement around the wrist, head speed is higher, the implement is easier to swing, and it is easier to put spin on the ball.

The weighting structure in which the above-described weight is used can be applied to a grip end of tennis rackets, soft tennis rackets, squash rackets, badminton rackets, or other such rackets, or to baseball or softball bats, golf clubs, hockey sticks, and other such ball-hitting implements.

BEST MODE FOR CARRYING OUT THE INVENTION

The present invention will now be described in further detail with reference to the accompanying drawings.

Embodiment 1

Figure 1:
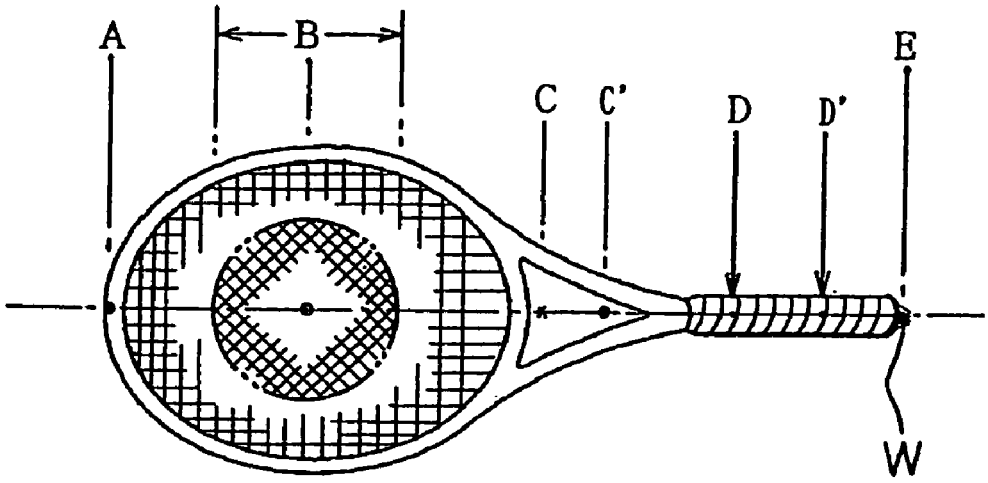
FIG. 1 is a diagram illustrating a standard tennis racket, which represents a ball-hitting implement.

A standard tennis racket is shown in FIG. 1. In FIG. 1, AE is the overall length of the racket, B is the impact point (range), C (before weight is mounted) and C' (after weight is mounted) are the racket balance point (center of gravity) when a ball is not being hit, and D (before weight is mounted) and D' (after weight is mounted) are the center of impact on the grip (node of vibration). The impact force with the ball acts on B when the ball is hit.

As shown above, when the weight W is mounted at the grip end bottom, the center of gravity of the racket when no ball is being hit shifts from C to C'. Therefore, the center of gravity shifts toward the portion grasped by the hand, which makes snap movement easier and increases head speed.

Also, the center of impact on the grip (node of vibration) shifts from D to D'. When the player employs a standard grip, the portion grasped by the hand (grip fulcrum) is located about 7 cm (2.8 inches) away from the grip end, and when D' comes to this position, the player is gripping the node of vibration, which minimizes impact vibration and makes hitting the ball more comfortable.

The basic vibration of a racket when a ball is hit is two-node flexural vibration, with the nodes of vibration being on the grip and the string plane (the so-called sweet spot approximated by B); but if the hand grasps the node on the grip, and the ball is hit at the node on the string plane (center impact), then the vibration (energy) transmitted to the hand will be minimized and loss of rebound of the racket will also be avoided.

The weight design of the weight based upon experimental findings is verified as follows:

When a 50 g (1.7 oz) weight is mounted on the grip end bottom of a 300 g (10.1 oz) racket, the node of vibration shifts from a position 12 cm (4.8 inches) away from the grip end (before the weight is mounted) to a position 7 cm (2.8 inches) away. In general, if the weight of the weight is increased or decreased by 10 g (0.4 oz), the node of vibration on the grip will shift 1 cm (0.4 inches).

As seen from the above, when a weight is thus mounted to the grip end bottom, the node of vibration on the grip shifts in the grip end direction. Incidentally, if the distal end of the frame is weighted with an eye toward increasing rebound, the node of vibration will shift in the opposite direction, so the object and effect of this is different from those of the present invention.

Therefore, in order to shift the node of vibration on the grip (90 to 180 mm (3.6 to 7.2 inches) from the grip end) to the portion usually grasped by the hand (60 to 80 mm (2.4 to 3.2 inches) from the grip end in the case of a single hand grip) on a lightweight, top-heavy racket, a weight of 10 to 120 g (0.4 to 4.0 oz) is mounted to the grip end bottom. In the case of a double hand grip, the weighting design should be made so as to shift the node of vibration to a position 70 to 140 mm (2.8 to 5.6 inches), and preferably 80 to 120 mm (3.2 to 4.8 inches), from the grip end.

Figures 2A, 2B:
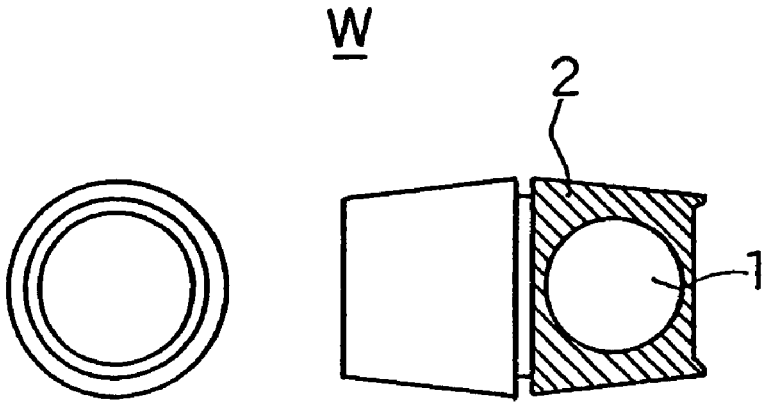
FIG. 2(*a*) is a partially cut-away front view of the weight, and FIG. 2(*b*) is a left side view thereof.

As shown in FIG. 2, the weight W is comprised of a soft material 2 (such as natural rubber, or a silicone or other synthetic rubber), capable of absorbing impact vibrations and compositely integrated with a loading member 1 (such as lead) composed of a high specific gravity substance, including this loading member 1, being incorporated into, embedded in, surrounded by, joined to, compounded with, or dispersedly compounded with in the soft material 2. This soft material 2 has axially symmetric wall thickness in cross section and is molded in the approximate shape of a barrel, and a circumferential groove 21 is provided around the large-diameter middle.

Figure 3:
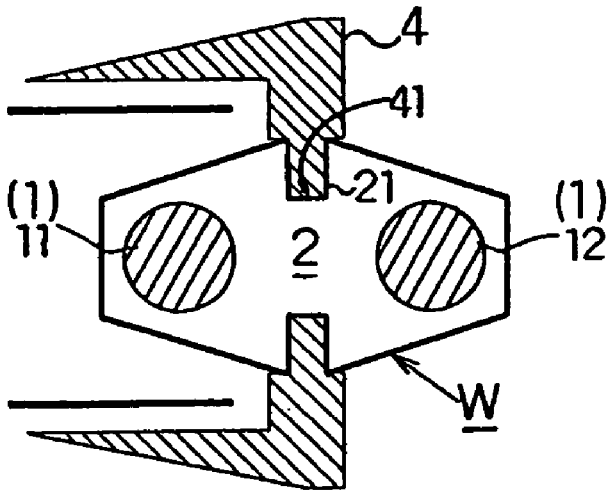
FIG. 3 is a cross sectional view of the weighting structure.

As shown in FIG. 3, a body component is elastically deformed into a mounting hole 41 formed in the grip end bottom of a tennis racket, so that the body component is fitted to the peripheral edge of the mounting hole 41. One half of the body is housed inside the grip via the side walls of the mounting hole 41, while the other half of the body protrudes from the grip end bottom and is thus balance-mounted.

Accordingly, when mounted, the loading members 1 are isolated by the soft material 2 region interposed in the grip end member 4 that includes an end cap.

The weighting range should be individually selected for each user so that play will not be hindered; and for practical purposes the weighting range is 10 to 120 g, and preferably 10 to 80 g. In commercial product form, the weight W is provided to the market in different classes or grades depending on how much each weight weighs.

The weighting range should be individually selected for each user so that play will not be hindered; and for practical purposes the weighting range is 10 to 120 g (0.4 to 4.0 oz), and preferably 10 to 80 g (0.4 to 2.7 oz). In commercial product form, the weight W is provided to the market in different classes or grades depending on how much each weight weighs.

In terms of balancing, the internal weighting element 11 and the external weighting element 12 may be either equal or unequal loads. If the load is unequal, the product can be designed so that the weighting balance between the internal weighting element 11 and the external weighting element 12 is changed by switching the mounting direction.

Figure 4:
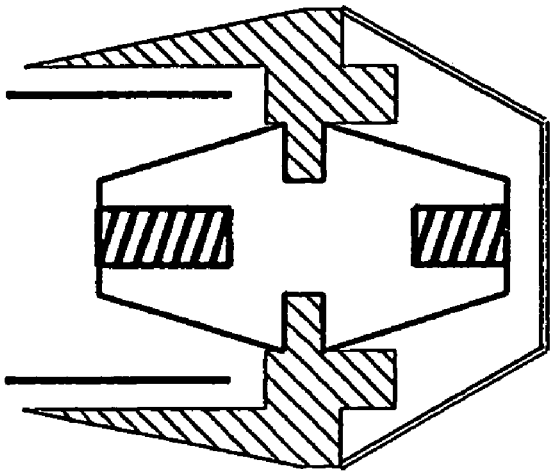
FIG. 4 is a cross sectional view of a modified example of Embodiment 1.

A protective cap for preventing the weight from falling out may be provided. FIG. 4 illustrates a modified example thereof.

Figure 5:
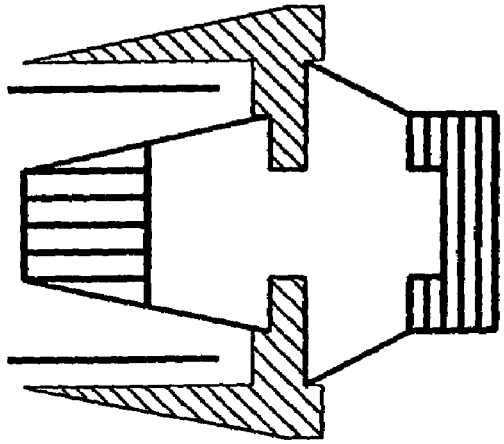
FIG. 5 is a cross sectional view of another modified example of Embodiment 1.

The shape of the loading member 1 and how it is integrated (compounded) can vary; and the loading member 1 can be incorporated into, embedded in, surrounded by, joined to, compounded with, or dispersedly compounded with (composite) in a matrix of the soft material 2. A modified example is shown in FIG. 5.

Figure 6:
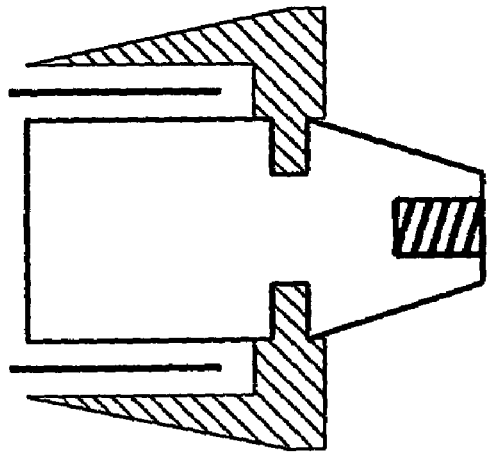
FIG. 6 is a cross sectional view of yet another modified example of Embodiment 1.

The internal weighting element 11 does not necessarily have to be a loading member. It can instead be substituted with the weight of the soft material 2 itself if the space this soft material takes up is enlarged. A modified example of this is shown in FIG. 6.

Figure 7:
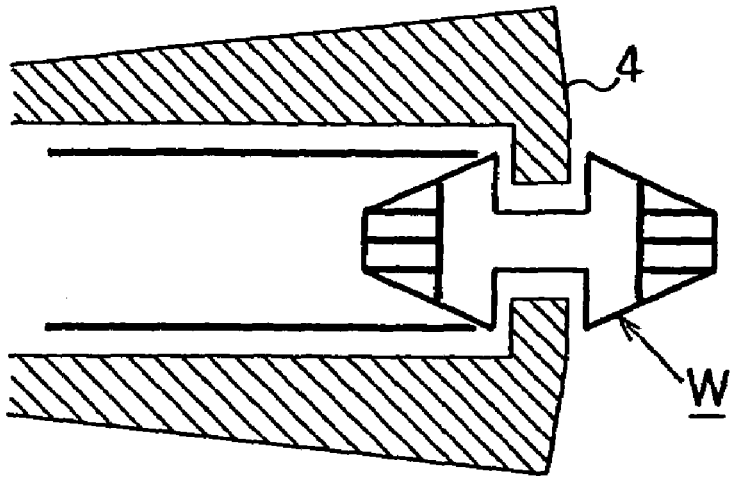
FIG. 7 is a cross sectional view of an example of application to a golf club.

The mounting hole 41 is made by boring out the bottom surface of an end cap (or a grip end member 4 including the same), and an engagement means that allows fitting, pressing, squeezing, or threading in conjunction with the weight W (soft material 2) is formed at the peripheral edge or end face of this mounting hole 41. The configuration of this means should be tailored to the intended application to various ball-hitting implements. For the sake of reference, FIG. 7 shows an application example of mounting to the end rubber bottom of a golf club.

Embodiment 2

Figure 8:
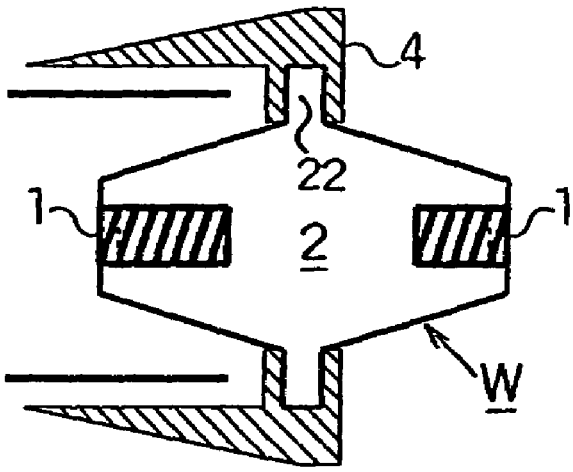
FIG. 8 is a cross sectional view of another weight and the weighting structure thereof.

As shown in FIG. 8, the soft material 2 is formed in the approximate shape of a barrel, just as in Embodiment 1; but a circumferential flange 22 is provided around the large-diameter middle instead of the circumferential groove 21. Therefore, a mating groove is formed in the end face of the mounting hole 41, and the circumferential flange is fitted therein. The only difference here is that the male/female orientations of the fitting members (2 and 4) are reversed.

Embodiment 3

Figure 9:
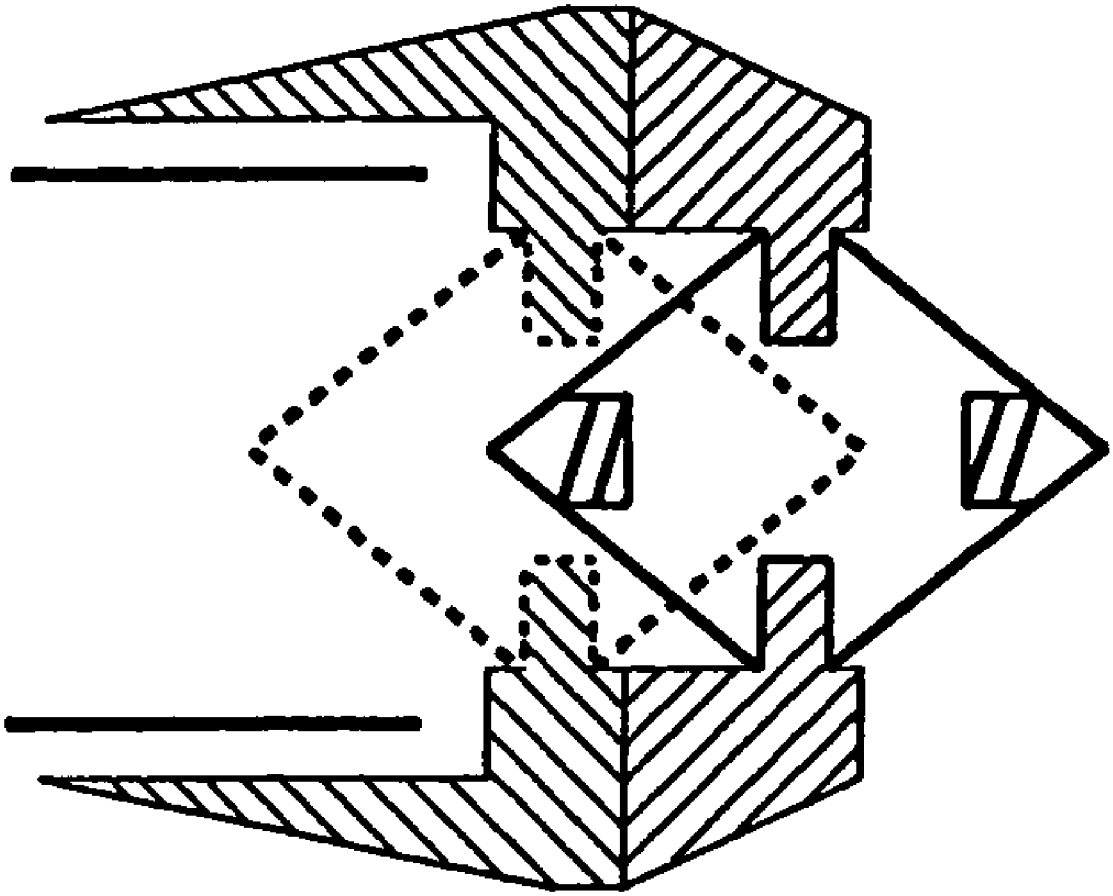
FIG. 9 is a cross sectional view of yet another weight and the weighting structure thereof.

As seen from FIG. 9, shown therein is an example of another weighting structure, in which the ball-hitting implement is provided with two end caps or is provided with a single cap that is formed thick so that the mounting hole is provided in two levels or steps. As a result, the mounting position can be changed. Such a balancing means can be variously modified as long as the essence of the weighting structure of the present invention is kept.

The weights in the above-described embodiments can be marketed as a set with a grip end member in which a mounting hole is formed, and provided as a part of a constituent member of the grip end.

The essence of the present invention should understood from the various embodiments given above, but the protected scope of the present invention is not limited by these embodiments; and various modifications are possible as long as the requirements below are met.

In the constitution of the weight, it is important that this weight be a composite of a loading member and a soft material and that the loading member be divisible into an internal weighting element and an external weighting element.

Also, in the constitution of the weighting structure in which this weight is used, it is important that the mounted loading member be isolated by a soft material region interposed in the grip end member that includes an end cap, and that this weighting structure at least be easy to mount and afford versatility in balancing, that is, allow the weight distribution to be easily changed by remounting.

Naturally, all of this must not compromise the operation and effect of the present invention, namely, that there be an increase in the moment of inertia around the center of gravity when a ball is hit, and that impact vibration be suppressed or absorbed (attenuated).

INDUSTRIAL APPLICABILITY

As discussed above, according to the present invention, a loading member composed of an internal weighting element and an external weighting element is disposed at the grip end bottom of a ball-hitting implement, and the center of gravity of the implement is shifted toward the portion grasped by hand, which makes the implement head-light (grip-heavy) just prior to impact and therefore easier to handle; and since the moment of inertia around the center of gravity is increased at the instant of impact, the player's swing or stroke is not overcome by the ball, and hitting the ball is more comfortable.

As to this improvement in hitting comfort, it has been found that the non-impact position at the time of center impact (the node of vibration on the grip in two-node flexural vibration) is approximately 7 cm (2.8 inches) from the grip end (the grip fulcrum; the center of a standard grip position).

As to ease of use, since snap movement around the wrist is easier, head speed is higher in the swing or stroke action of hitting the ball, which means that the ball is hit faster and it is easier to put spin on the ball, allowing the player to swing more easily. Therefore, the present invention ameliorates the drawback of more difficult swinging when applied to the longer rackets have been increasingly popular in recent years.

Also, since the loading member is isolated by the soft material region interposed in the grip end member that includes the end cap, the impact vibration produced during hitting is effectively suppressed or absorbed (attenuated), making hitting more comfortable. Furthermore, since the weight is balanced between the inside and outside of the grip end bottom, it will not fall out during play.

Overall, discomfort such as numbness or excessive load on the body caused by impact is reduced, which makes the implement easier to use and prevents injury, and thereby helps to raise the level of play.

The invention claimed is:

1. A grip end bottom weighting structure, wherein:

a grip end bottom weight is removably mounted on a grip end of a ball-hitting implement, said grip end bottom weight being characterized in that a soft material, capable of absorbing impact vibrations and in composite integration with a loading member composed of a high specific gravity substance, is integrally formed so as to have axially symmetric wall thickness in cross section and to be mounted by elastically deforming a body component thereof in a mounting hole formed in a grip end bottom of said ball-hitting implement, with at least half of said body component of said soft material protruding from said grip end bottom when mounted;

a moment of inertia around center of gravity is increased at a time a ball is hit; and an impact vibration is suppressed, absorbed or attenuated.

2. A grip end bottom weighting structure from a grip end bottom of a ball-hitting implement, wherein said grip end bottom weighting structure is characterized by being comprised of:

a grip end member that includes an end cap or an end rubber and is provided with a mounting hole formed in a planar center thereof, a loading member composed of a high specific gravity substance, and a soft material which is in composite integration with said loading member; and wherein said soft material has axially symmetric wall thickness in cross section and is formed so as to be mounted by elastic deformation of a body component thereof, at least half of said body component of said soft material is fixed to protrude from said grip end bottom of said bull-hitting implement, and a soft material region of said soft material is disposed so as to isolate said loading member by means of said grip end member, thus allowing moment of inertia around center of gravity to increase at a time a ball is hit and an impact vibration to be suppressed, absorbed, or attenuated.

3. The grip end bottom weighting structure according to claim 2, wherein said composite integration is obtained in said loading member by being incorporated into, embedded in, surrounded by, joined to, compounded with, or dispersed in a matrix of said soft material, said mounting hole is formed by boring out a bottom surface of a grip end member that includes said end cap or said end rubber, and said soft material is mounted by being removably fitted, pressed, squeezed, or threaded into said mounting hole by stored elastic energy; and wherein said soft material is non-rotatably restrained in said mounting hole and is balance-mounted, with one half of said body component housed inside a grip via side walls of said mounting hole, and with another half of said body component protruding from said grip end bottom.

4. The grip end bottom weighting structure according to claim 2 or 3, wherein said soft material is molded in an approximate shape of a barrel, and a circumferential groove or flange is provided around a large-diameter middle thereof and fitted to a peripheral edge of said mounting hole, allowing said weight to be removably mounted.

5. The grip end bottom weighting structure according to claim 4, wherein said loading member is disposed inside of two ends of said soft material, with its weight divided into an internal weighting element and an external weighting element when mounted on said ball hitting implement.

6. The grip end bottom weighting structure according to claim 4, wherein said ball-hitting implement is provided with two end caps or end rubbers or is formed tick so that said mounting hole is provided in two levels or steps, thus allowing a mounting position to be changed.

7. The grip end bottom weighting structure according to claim 4, wherein an application of weight of between 10 and 120 g (0.4 to 4.0 oz) is made to said grip end bottom of said ball-hitting implement, thus shifting center of impact (a node of vibration) on a grip to a portion to be grasped by hand (the grip fulcrum).

8. The grip end bottom weighting structure according to any one of claims 2 to 3, wherein said loading member is disposed inside of two ends of said soft material, with its weight divided into an internal weighting element and an external weighting element when mounted on said ball hitting implement.

9. The grip end bottom weighting structure according to claim 8, wherein said ball-hitting implement is provided with two end caps or end rubbers or is formed thick so that said mounting hole is provided in two levels or steps thus allowing a mounting position to be changed.

10. The grip end bottom weighting structure according to claim 8, wherein an application of weight of between 10 and 120 g (0.4 to 4.0 oz) is made to said grip end bottom of said ball-hitting implement, thus shifting center of impact (a node of vibration) on a grip to a portion to be grasped by hand (the grip fulcrum).

11. The grip end bottom weighting structure according to any one of claims 2 to 3, wherein said ball-hitting implement is provided with two end caps or end rubbers or is formed thick so that said mounting hole is provided in two levels or steps, thus allowing a mounting position to be changed.

12. The grip end bottom weighting structure according to claim 11, wherein an application of weight of between 10 and 120 g (0.4 to 4.0 oz) is made to said grip end bottom of said ball-hitting implement, thus shifting center of impact (a node of vibration) on a grip to a portion to be grasped by hand (the grip fulcrum).

13. The grip end bottom weighting structure according to any one of claims 2 to 3, wherein an application of weight of between 10 and 120 g (0.4 to 4.0 oz) is made to said grip end bottom of said ball-hitting implement, thus shifting center of impact (a node of vibration) on a grip to a portion to be grasped by hand (the grip fulcrum).

14. The grip end bottom weighting structure according to any one of claims 2 and 3, wherein said bail-hitting implement is one selected from among a tennis racket, a soft tennis racket, a squash racket, a badminton racket and another racket, a baseball or softball bat, a golf club, and a hockey stick.

* * * * *